US008800073B2

(12) United States Patent
Hoernig et al.

(10) Patent No.: US 8,800,073 B2
(45) Date of Patent: Aug. 12, 2014

(54) TUB AND SHOWER SURROUND WITH HIDDEN STORAGE

(75) Inventors: Victor Hoernig, Lowell, IN (US); Geraint Krumpe, Chicago, IL (US); Manki Yoo, Skokie, IL (US); Andrew Mercidita, Chicago, IL (US); Angela Biagi, Brooklyn, NY (US); Chia-Ying Lee, Chicago, IL (US); Emilie Williams, Chicago, IL (US); Ross Carl, River Forest, IL (US)

(73) Assignee: Masco Corporation of Indiana, Indianapolis, IN (US)

( * ) Notice: Subject to any disclaimer, the term of this patent is extended or adjusted under 35 U.S.C. 154(b) by 1315 days.

(21) Appl. No.: 12/533,110

(22) Filed: Jul. 31, 2009
(Under 37 CFR 1.47)

(65) Prior Publication Data

US 2010/0115693 A1 May 13, 2010

Related U.S. Application Data

(60) Provisional application No. 61/189,056, filed on Aug. 15, 2008.

(51) Int. Cl.
*A47K 3/34* (2006.01)

(52) U.S. Cl.
USPC ..... 4/614; 4/609; 4/612; D23/305

(58) Field of Classification Search
USPC ..... 4/584, 609, 612, 614; D23/283, 305
See application file for complete search history.

(56) References Cited

U.S. PATENT DOCUMENTS

| | | | | |
|---|---|---|---|---|
| 3,722,151 | A | 3/1973 | Gardner | |
| 3,827,086 | A | 8/1974 | Seymour et al. | |
| 3,995,330 | A | 12/1976 | Meyers | |
| 4,067,071 | A | 1/1978 | Altman | |
| 4,299,064 | A * | 11/1981 | Daniels | 4/584 |
| 4,424,598 | A | 1/1984 | Cima | |
| 5,312,179 | A | 5/1994 | Schlaud et al. | |
| 5,329,651 | A | 7/1994 | Mardero | |
| D578,187 | S | 10/2008 | Biagi | |
| D578,624 | S * | 10/2008 | Biagi et al. | D23/305 |
| 8,096,000 | B2 * | 1/2012 | Helmetsie et al. | 4/614 |
| 2009/0100592 | A1 | 4/2009 | Biagi | |

FOREIGN PATENT DOCUMENTS

WO 2006091596 8/2006

OTHER PUBLICATIONS

European Search Report received Jan. 11, 2012.

* cited by examiner

*Primary Examiner* — Tuan N Nguyen
(74) *Attorney, Agent, or Firm* — Carlson, Gaskey & Olds, PC

(57) ABSTRACT

A surround for use in a bath or a shower has a back and a side. The side has a protrusion extending therefrom. An open shelf attaches to either the back or the side. The protrusion at least partially restricts a view of the shelf.

14 Claims, 10 Drawing Sheets

TUB AND SHOWER SURROUND WITH HIDDEN STORAGE

REFERENCE TO RELATED APPLICATION

The application claims priority to U.S. Provisional Application No. 61/189,056 which was filed on Aug. 15, 2008.

BACKGROUND OF THE INVENTION

Conventional tub and shower surrounds often include storage locations and shelves upon which bathing products, such as shampoo, soaps, razors and lotions are stored for ready use. These bathing products are also viewable to an observer outside of the tub or shower surround.

Some tub and shower surrounds hide the bathing products by enclosing them in cabinets.

Consumers are also becoming more sophisticated about the aesthetics of their bath rooms and are demanding that their tub and shower surrounds have a pleasant look.

SUMMARY OF THE INVENTION

According to the invention, a bath or shower surround includes an open shelf that is at least partially hidden from view by a projection, from a user who is standing in front of the bath or shower surround.

According to a feature of the invention, the storage area may be partially hidden from view.

According to an aspect of the invention, the projection forms a continuation of the design of the shower and tub surround.

BRIEF DESCRIPTION OF THE DRAWINGS

These and other features of the present invention can be best understood from the following specification and drawings, the following of which is a brief description.

DETAILED DESCRIPTION

Figure 1B:
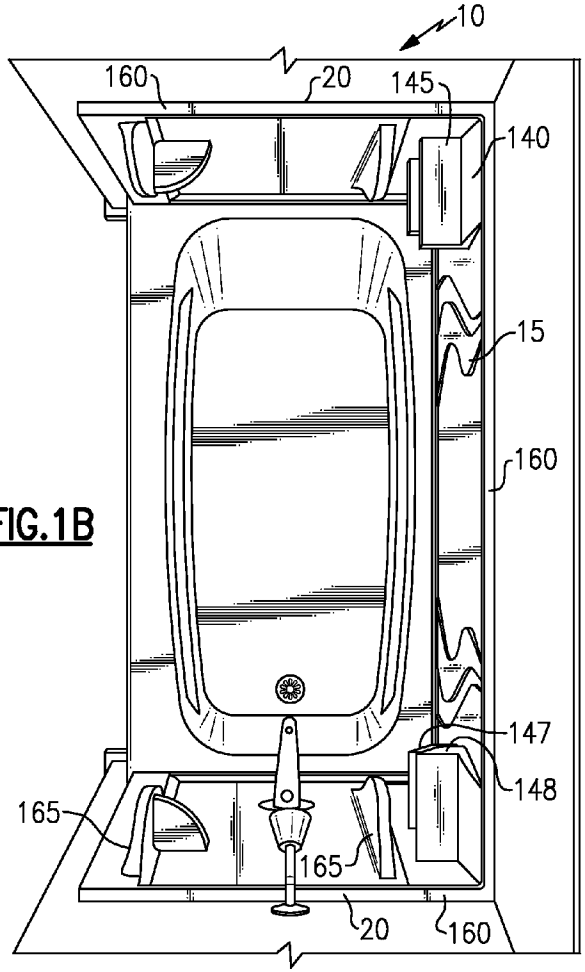
FIGS. 1A and 1B illustrate a tub and shower surround according to one non-limiting embodiment.
Figure 1A:
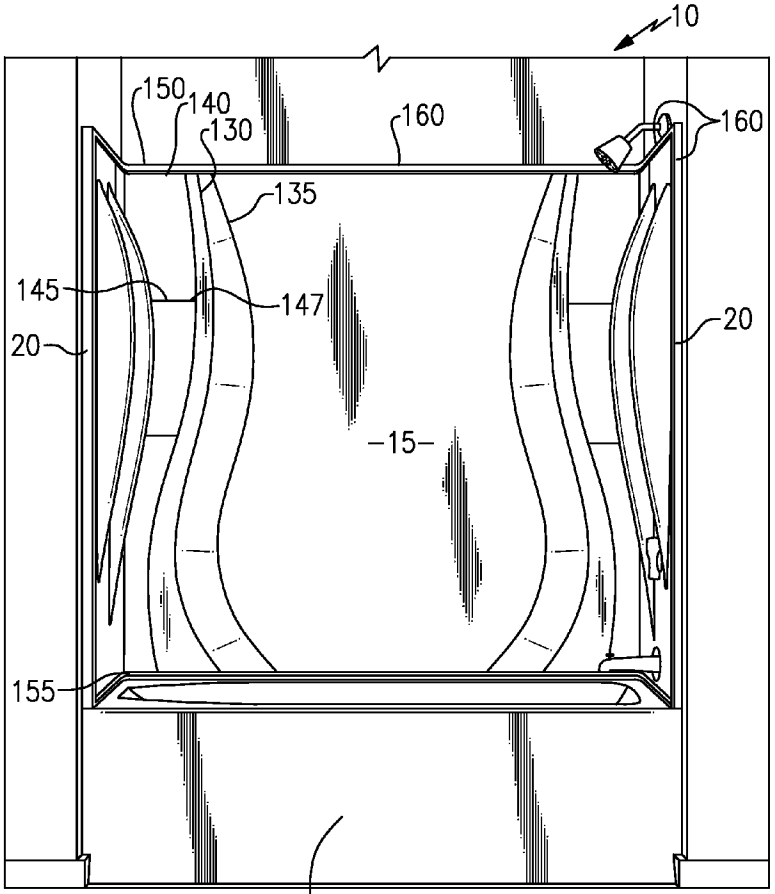

According to the invention and referring to FIGS. 1A and 1B, a shower or bath surround (for ease of description the shower or bath surround shall be henceforward referred to as "surround") 10 has a back wall 15 and a pair of side walls 20 that are generally perpendicular to the back wall. The side walls may form one piece with the back wall or may be attached thereto by conventional means.

Referring to the Figures, one of ordinary skill in the art will recognize that the Figures shown herein relate to shower and bath combinations and that the concepts of this invention readily apply to showers without a tub or tubs without a shower as well. Further, it should be understood that the surround 10 is readily secured to an underlying structure such as wall studs (not shown) as is known in the art. Throughout the description of this invention, the back wall 15 may include a portion of each side wall 20 and each side wall may form a portion of the back wall. The back and side walls may also be joined by a corner piece 30 as will be disclosed herein. Each corner piece is connected to the back wall and each sidewall by conventional means as are known in the art. The side walls, any corner piece and rear wall may be formed at least partially around a tub 25.

The surround of FIGS. 1A and 1B, shows a back wall 15 that includes a plurality of decorative raised portions 130, 135 that are molded into the back wall and roughly track the shape of each other. The decorative raised portions form a harp shape. The back wall also has a raised curved portion 140 from which integrally formed shelves 145, e.g., storage areas, extend therefrom. Each shelf melds from an outer portion 147 to a back portion 148 of a lower shelf. The raised curved portion 140 bows outwardly from a top of the back wall 150 and from a bottom 155 of the back wall and feathers into the top of the back wall and the bottom of the back wall. A decorative molding 160 edges the back wall and the side walls. The raised curved portion 140 and the shelves 145, while molded on the back wall 15, also form a portion of side walls 20.

Each side wall 20 has a pair of integrally molded curved protrusions 165 extending therefrom. The protrusion closest to the front of the tub has a shelf 170 molded therein.

As illustrated in FIG. 1A, an observer viewing the surround 10 from a front thereof, will not view the entirety of the shelves 145, but rather views the protrusions 165, which form a portion of the overall design of the surround 10. Of course, an observer viewing the surround from particular angles may view additional portions of the shelves 145, however, the projections 165 conceal a significant portion of the shelves 145 thereby improving the aesthetic appearance of the surround 10 as products (not shown) on the shelves 145 are readily obscured. Shelf 170 is completely obscured from view. The raised curved portion, in conjunction with the decorative raised portions 130, 135 and the protrusions 165 on the side walls provide a pleasing look.

Figure 2B:
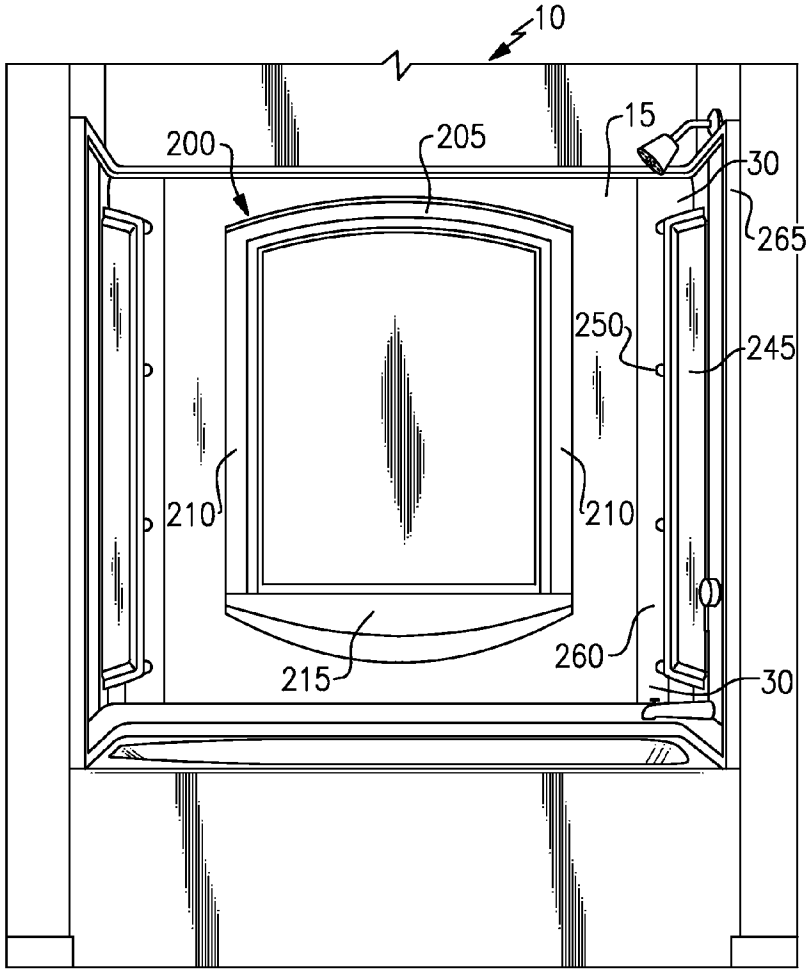
FIGS. 2A and 2B illustrate a shower surround according to another non-limiting embodiment.
Figure 2A:
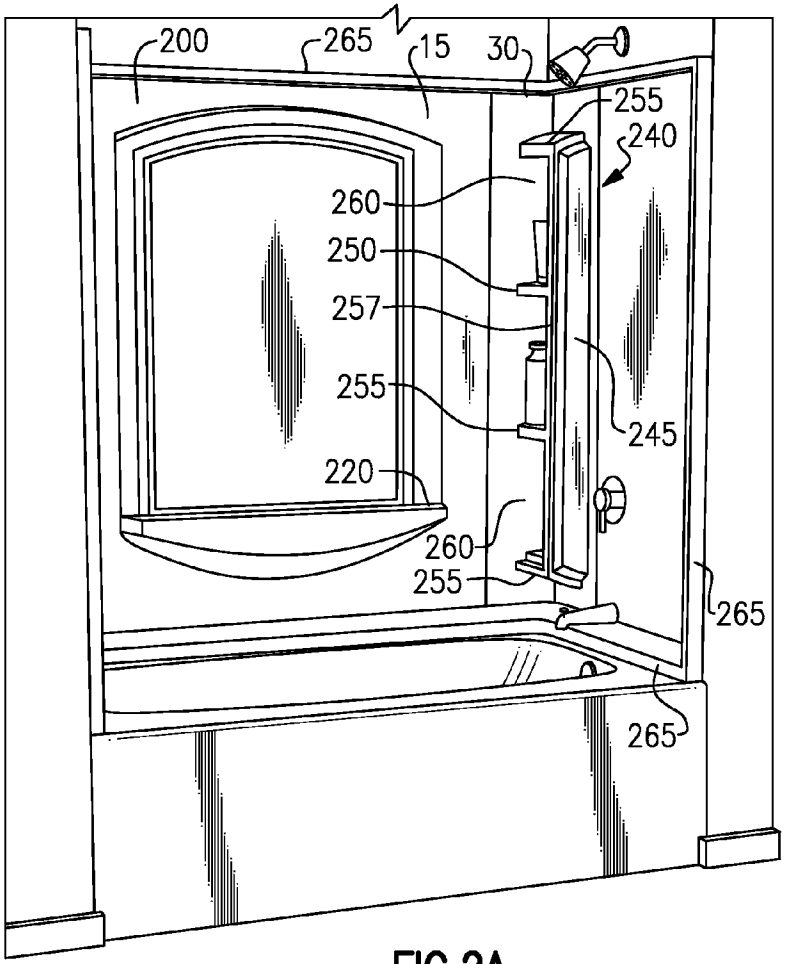

Referring now to FIGS. 2A and 2B a back wall 15 includes a window-shaped decorative molding 200 having a curved upper portion 205, a pair of side portions 210 extending downwardly from the curved upper portion and an extended sill 215 connecting the side portions. The sill forms a shelf 220 upon which products may be stored. The back wall 15 is connected to the sidewall 20 by a corner piece 30 that has a shelving unit 240 molded therein. The shelving unit has a front portion 245 and a plurality of shelves 250, and complementary top and bottom curved portions 255.

The front portion 245 of the shelving unit has a curved upper portion and a curved lower portion 255 that mimic the curve of the curved upper portion 205 of the window-shaped decorative molding. The front portion integrally attaches at a back 257 thereof to the shelves 250 that integrally attach, in turn, to a back portion 260 of the corner piece.

Further, the sidewalls, the corner pieces, and the back wall are edged by a molding 265 to give the surround 10 a room-like feel.

As illustrated in FIG. 2B an observer viewing the surround 10 will not view the entirety of the shelves 250 but would view mostly the back wall 15, corner piece 30 and side walls 20. Of course, an observer of the surround from other angles, may see additional portions of the shelves 250. However, the front portion 245 conceals a significant portion of the shelves thereby improving the aesthetic appearance of the surround 10 as products of the shelves are at least partially obscured. A viewer will appreciate though, that the back wall, the corner pieces, including that portion of the shelves that is visible, and the side walls provide an overall pleasing look Referring now to FIGS. 3A and 3B, the back wall 15 includes a decorative portion 300 having a molded pair of parallel side walls 305 and a molded pair of parallel top and bottom walls 310 that are connected by inversely-curved molded portions 315. The effect of the walls is to give a viewer the impression of a picture or mirror frame. The back wall 15 is connected to each sidewall 20 by a corner piece 30 that has a shelving unit 340 integrally molded therein. The shelving unit has a front portion 345 and a plurality of shelves 350, and complementary top and bottom portions 355.

The front portion 345 of the shelving unit 340 has a molded appearance that mimics the shape of the window-shaped decorative molding 300 and the top and bottom portions 355 have a curved upper portion 360 and a curved lower portion 365 that mimic the inversely-curved molded portions 315 of the back wall 15. The front portion integrally attaches at a back thereof 370 to the shelves that integrally attach, in turn, to a back portion 375 of the corner piece 30.

Further, the sidewalls, the corner pieces, and the back wall, are edged by a molding 380.

Figure 3B:
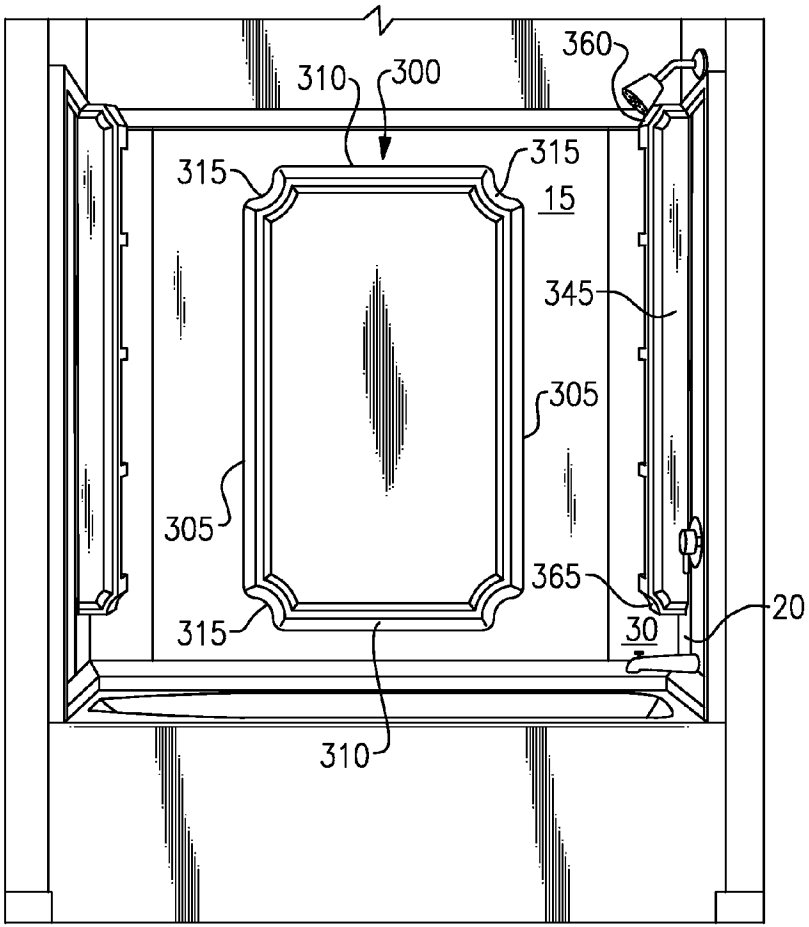
FIGS. 3A and 3B illustrate a shower surround according to another non-limiting embodiment.
Figure 3A:
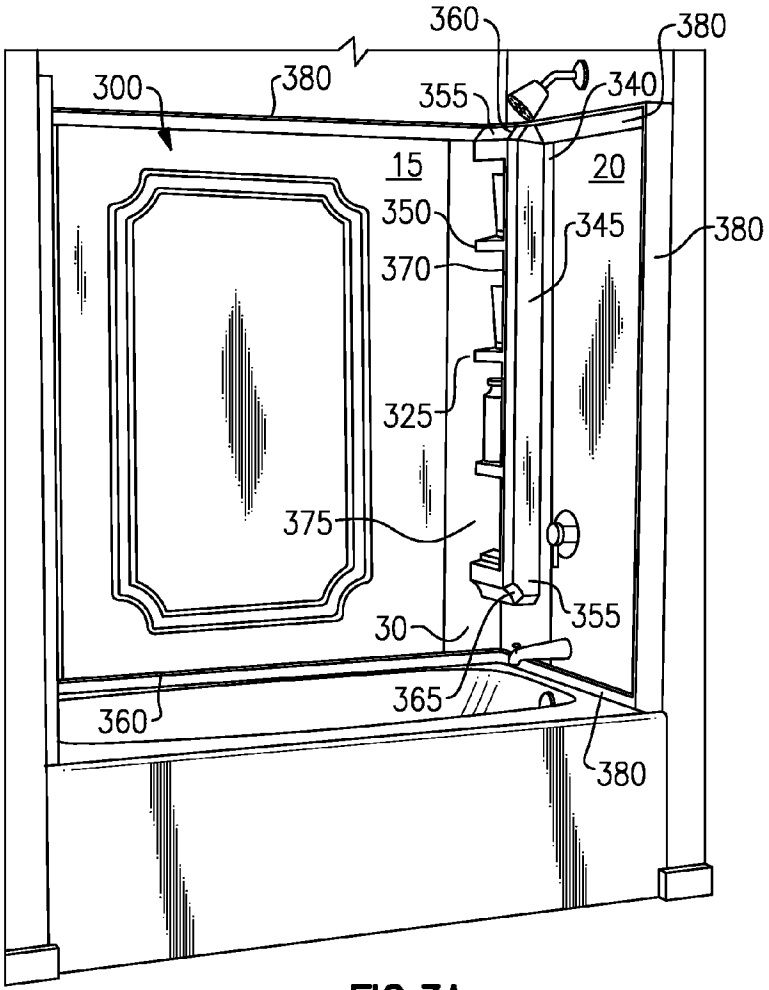

As illustrated in FIG. 3B an observer viewing the surround 10 will not view the entirety of the shelves 345 but would view mostly the back wall 15, corner piece 30 and side walls 20. Of course, an observer of the surround from other angles, may see additional portions of the shelves 345. However, the front portion 345 of the shelving unit 340 conceals a significant portion of the shelves thereby improving the aesthetic appearance of the surround 10 as products of the shelves are at least partially obscured. A viewer will appreciate though that the back wall, the corner pieces, including that portion of the shelves that is visible, and the side walls provide an overall pleasing look Referring now to FIGS. 4A and 4B, the back wall 15 is plain. The back wall 15 is connected to the sidewall 20 by a corner piece 30 that has a shelving unit 440 molded therein. The shelving unit has a front portion 445 and a plurality of shelves 450, and a top portion 455. The corner piece is connected to the back wall and each sidewall by conventional means as are known in the art.

The corner piece, on a back wall portion 460 thereof, has a raised truncated triangular shape 465 increasing in width from the top 470 of the corner piece to the bottom 475 thereof. The shelving unit front portion 445 curves from a top 480 of a side wall of the corner piece to a bottom portion 475 thereof. The shelving unit has a solid portion 485 attaching to the lower shelf and fits behind the curving front portion. The truncated triangular portion 465 and the seam 490 between the corner portions and the back wall gives a viewer the impression of a room with curtains. Each corner portion, on a side wall portion thereof, has a raised portion 495 that mimics the curved portion of the front wall of the shelving unit.

Further, the sidewalls, the corner pieces, and the back wall are edged by a molding 497 to give the surround 10 a room-like feel.

Figure 4B:
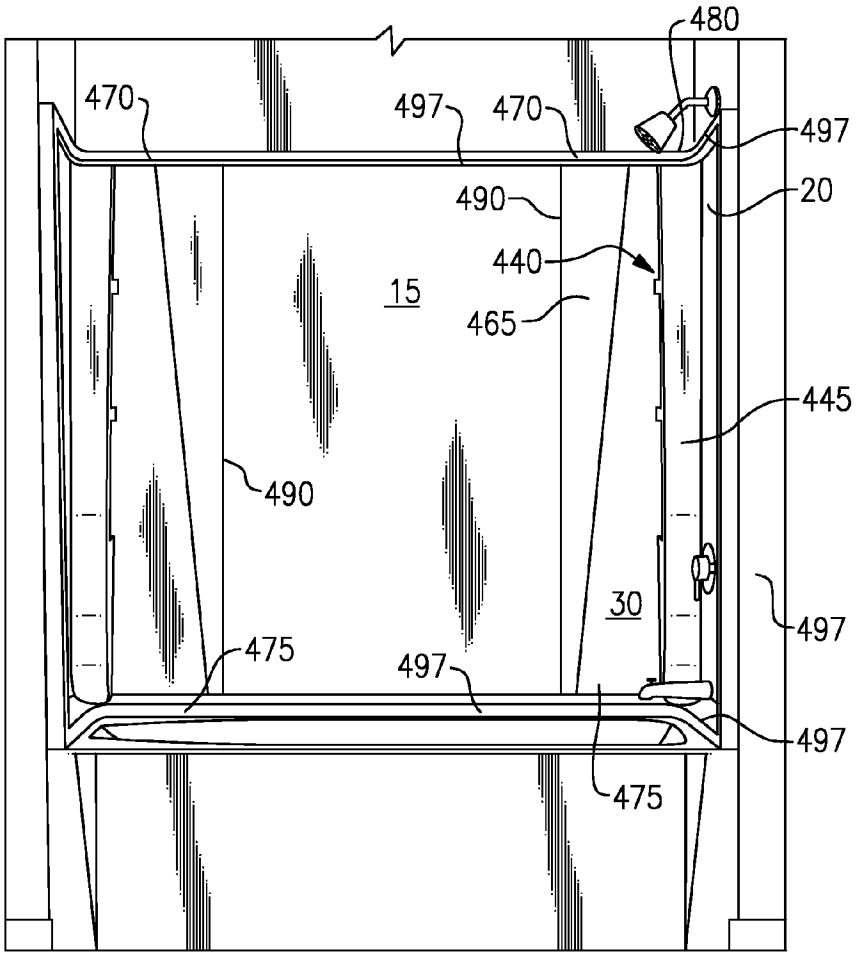
FIGS. 4A and 4B illustrate a shower surround according to another non-limiting embodiment.
Figure 4A:
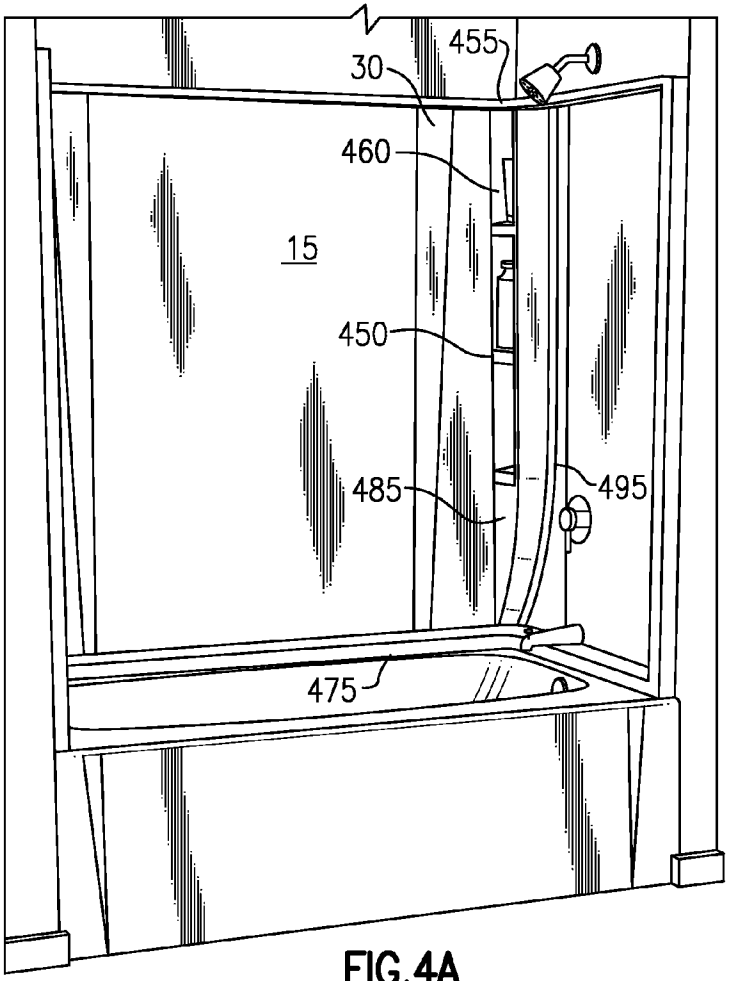

As illustrated in FIG. 4B an observer viewing the surround 10 will not view the entirety of the shelves 450 but would view mostly the back wall 15, corner piece 30 and side walls 20. Of course, an observer of the surround from other angles, may see additional portions of the shelves 450. However, the front wall of the corner portion conceals a significant portion of the shelves thereby improving the aesthetic appearance of the surround 10 as products of the shelves are at least partially obscured. A viewer will appreciate though that the back wall, the corner pieces, including that portion of the shelves that is visible, and the side walls provide an overall pleasing look.

Figure 5B:
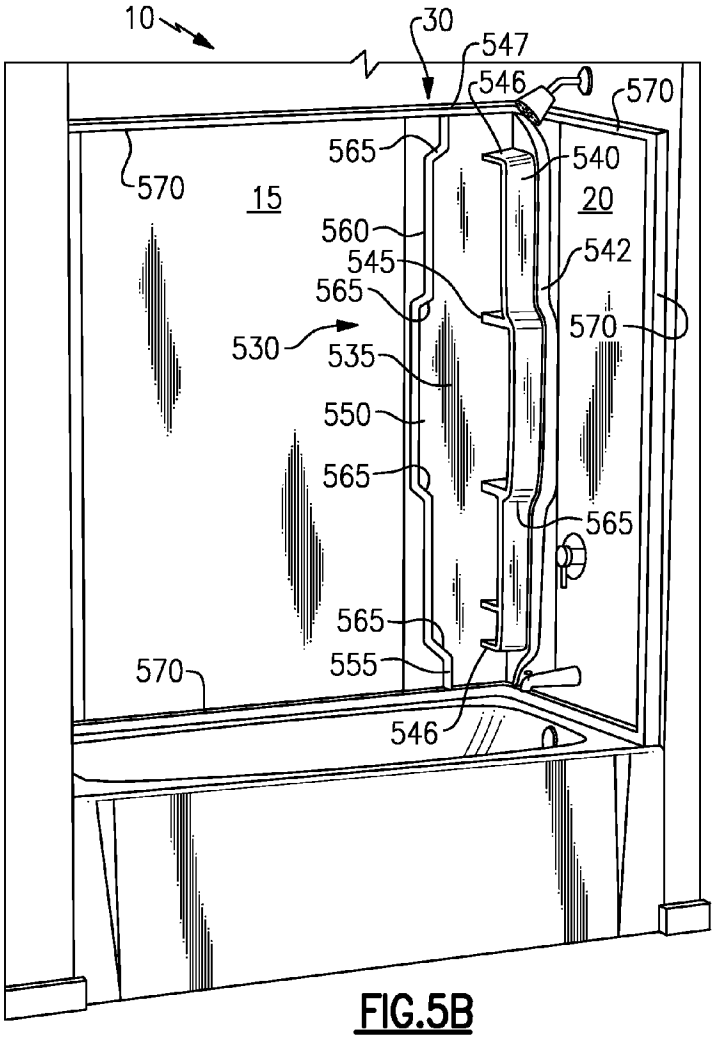
FIGS. 5A and 5B illustrate a shower surround according to another non-limiting embodiment.
Figure 5A:
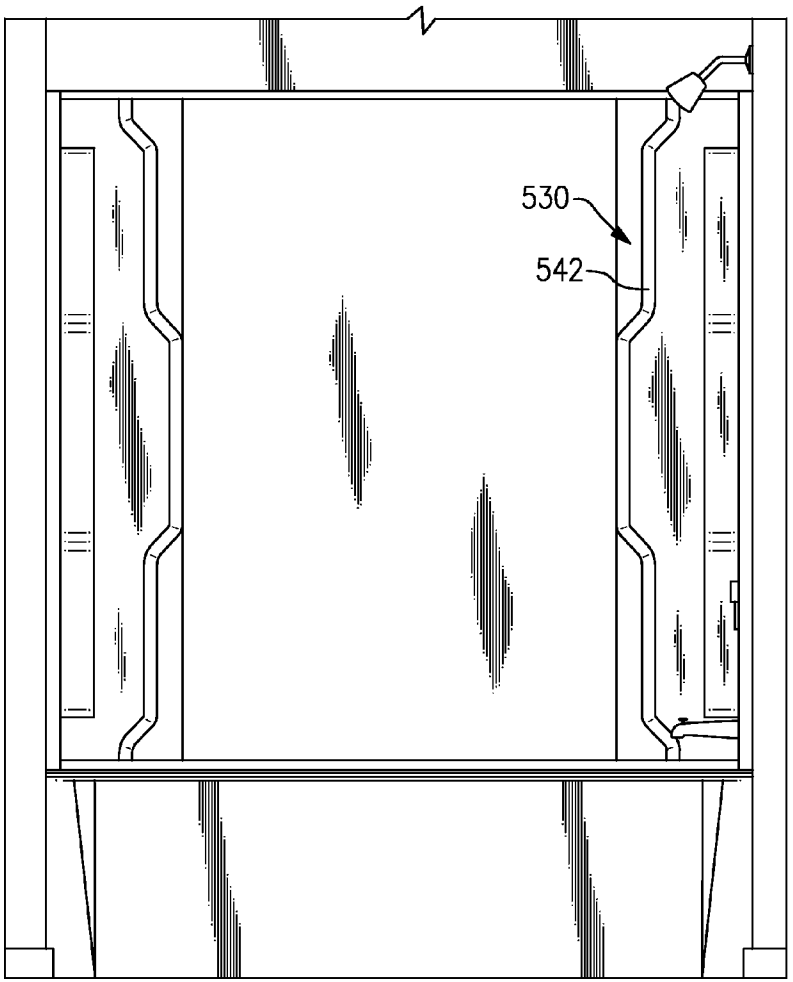

Referring now to FIGS. 5A and 5B, another embodiment of the invention is shown. The plain back wall 15 is connected to the sidewall 20 by a corner piece 30 that has a shelving unit 440 molded therein. The shelving unit has a front portion and a plurality of shelves, and a top portion. The corner piece 30 is connected to the backwall and each sidewall by conventional means as are known in the art.

The corner piece 30 has a complex symmetrical shape 530. The back wall portion 535 of the corner piece is duplicated partially by the shelving unit 540 and a raised portion 542 on the side wall portion of the corner piece. The shelving unit has shelves 545 and complementary shaped top and bottom portions 546. The shape 530 steps outwardly twice from the top 547 of the corner piece to a middle portion 550 and then steps inwardly twice to a bottom portion 555 of the of the corner piece. On the back wall portion of the corner piece, the shape is shadowed by a second raised portion 560. The steps are connected by angled portions 565. Shelves 545 are exposed side portion that is partially obscured from view.

Further, the sidewalls, the corner pieces, and the back wall, are edged by a molding 570 to give the surround 10 a room-like feel. The side walls also have a complementary molding attaching to the top molding and the bottom molding.

As illustrated in FIG. 5B an observer viewing the surround 10 will not view the entirety of the shelves 545 but would view mostly the back wall, corner piece and side walls. Of course, an observer of the surround from other angles may see additional portions of the shelves 545. However, the front wall of the corner portion conceals a significant portion of the shelves thereby improving the aesthetic appearance of the surround 10 as products of the shelves are at least partially obscured. A viewer will appreciate though that the back wall, the corner pieces, including that portion of the shelves that is visible, and the side walls provide an overall pleasing look.

Figure 6B:
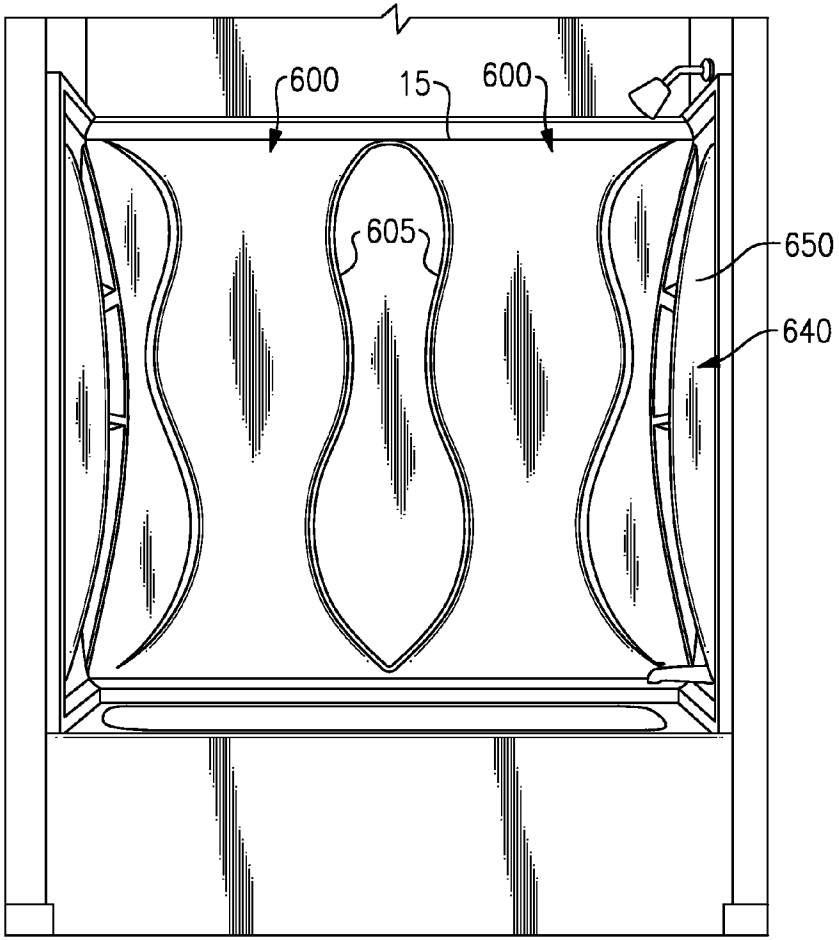
FIGS. 6A and 6B illustrate a shower surround according to another non-limiting embodiment.
Figure 6A:
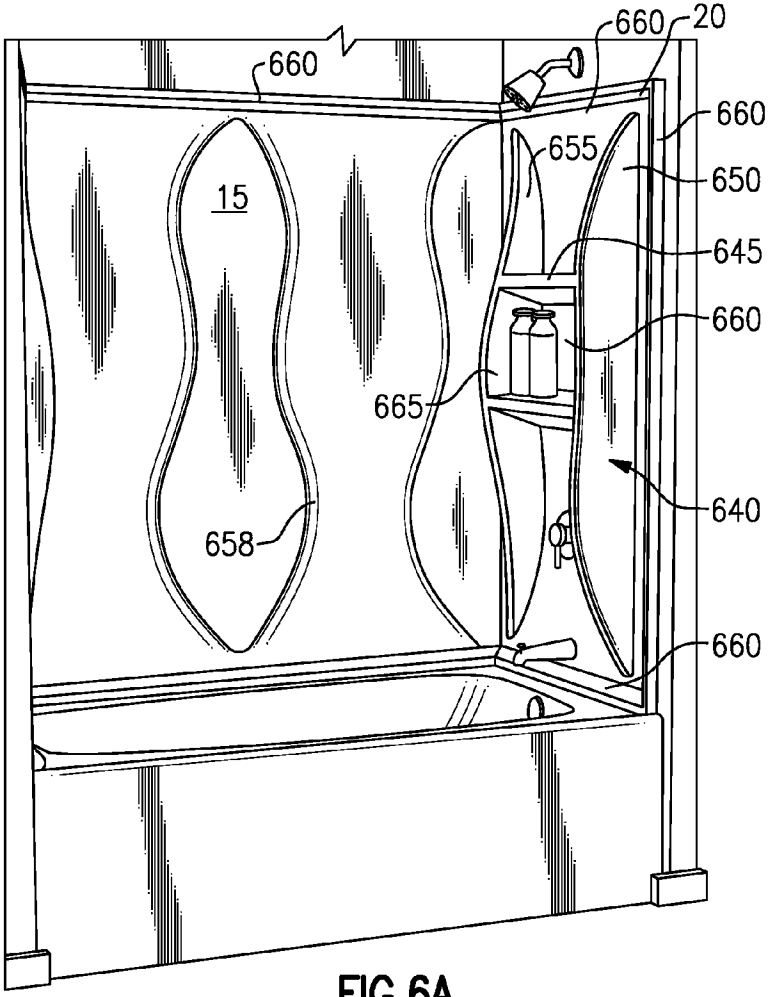

Referring now to FIGS. 6A and 6B, a back wall 15 includes a pair of urn-shaped decorative moldings 600. The urn-shaped moldings are each shadowed by another pair of urn-shaped moldings 605. The back wall 15 is connected to the sidewall 20 that has a shelving unit 640 molded therein. The shelving unit has a front portion 650, a back portion 655 and a plurality of shelves 645.

The front portion and the back portion 650, 655 of the shelving unit has a molded appearance that mimics the shape of a side 658 of the urn-shaped decorative molding 600. The shelves 645 are molded into the side wall 20 and the front and back portion of the shelving unit.

Further, the side walls and the back wall are edged by molding.

As illustrated in FIG. 6B an observer viewing the surround 10 will not view the entirety of the shelves 645 but would view mostly the back wall, corner piece and side walls. Of course, an observer of the surround from other angles, may see additional portions of the shelves 645. However, the sidewall conceals a significant portion of the shelves thereby improving the aesthetic appearance of the surround 10 as products of the shelves are at least partially obscured. A viewer will appreciate though that the back wall, the side walls and the shelving units, including that portion of the shelves that is visible, provide an overall pleasing look Referring now to FIGS. 7-10, four more embodiments of the invention are shown. The back wall 15, corner portion 30 and side walls 20 comprise a plurality of raised moldings 700 that form a branch and twig design. Each of the back portions, side portions and corner portions are edged by a molding 710. Each corner piece has a shelving unit 740 therein has a front portion 750, a plurality of shelves 745 that are molded into the back portion of the corner portion and the front portion 755. The front portion in FIGS. 7-9 also have a branch and twig design though there are differences.

Figure 7B:
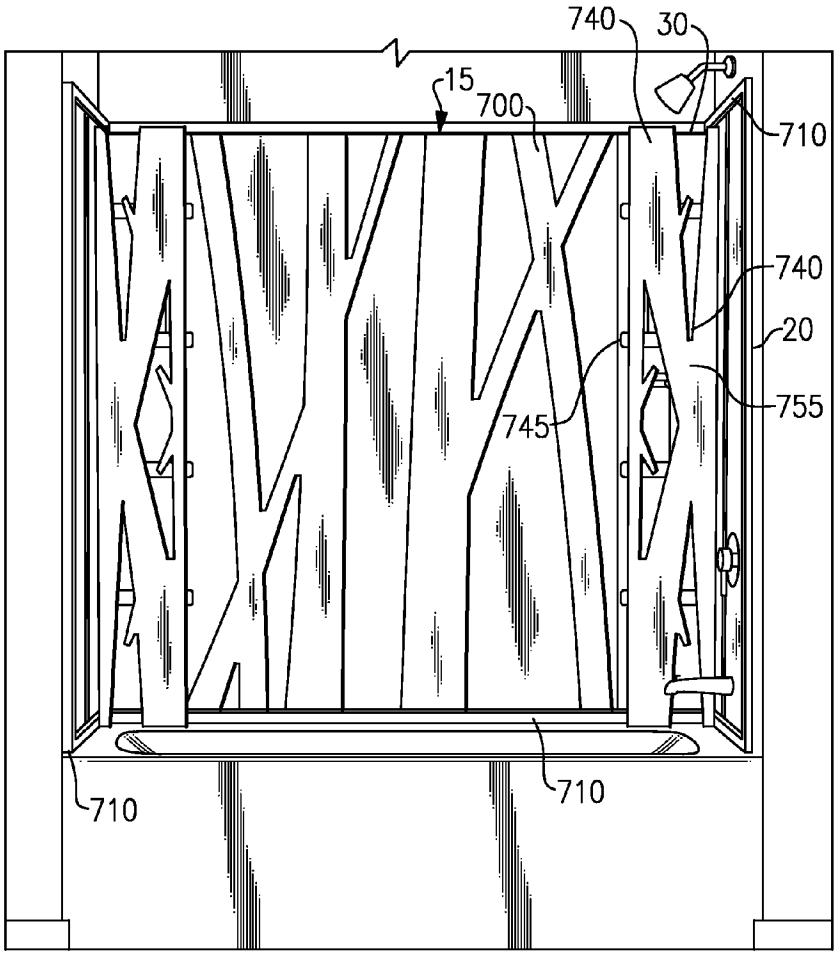
FIGS. 7A and 7B illustrate a shower surround according to another non-limiting embodiment.
Figure 7A:
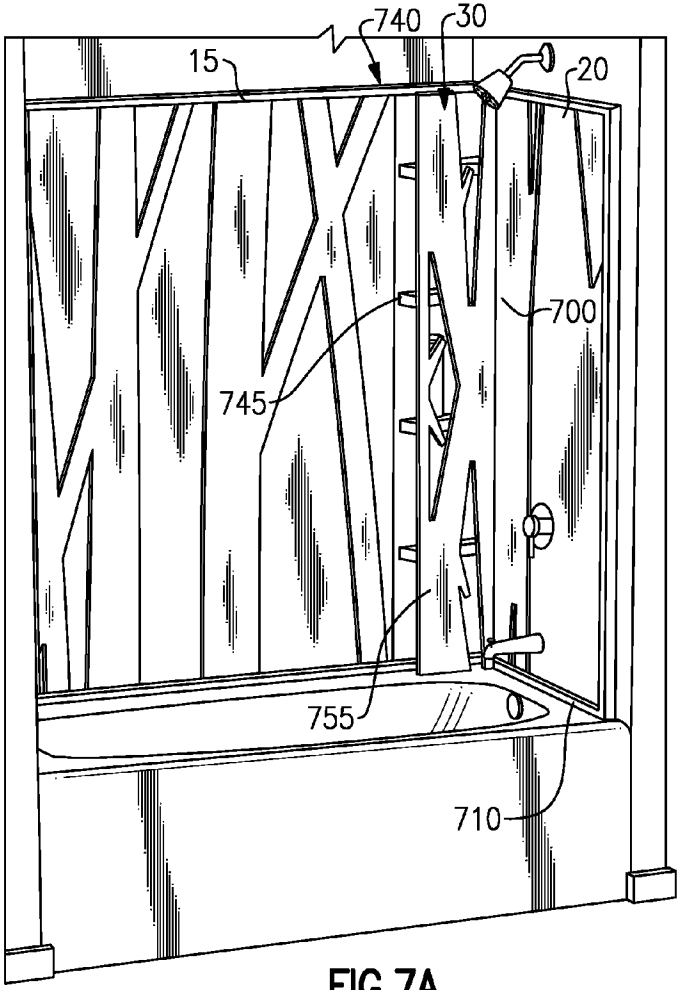

In FIGS. 7A and 7B the front portion has a plurality of cut-outs that emphasize the branch and twig design but allow the products P to be viewed therethrough. However, the front portion 750 is opaque.

Figure 8B:
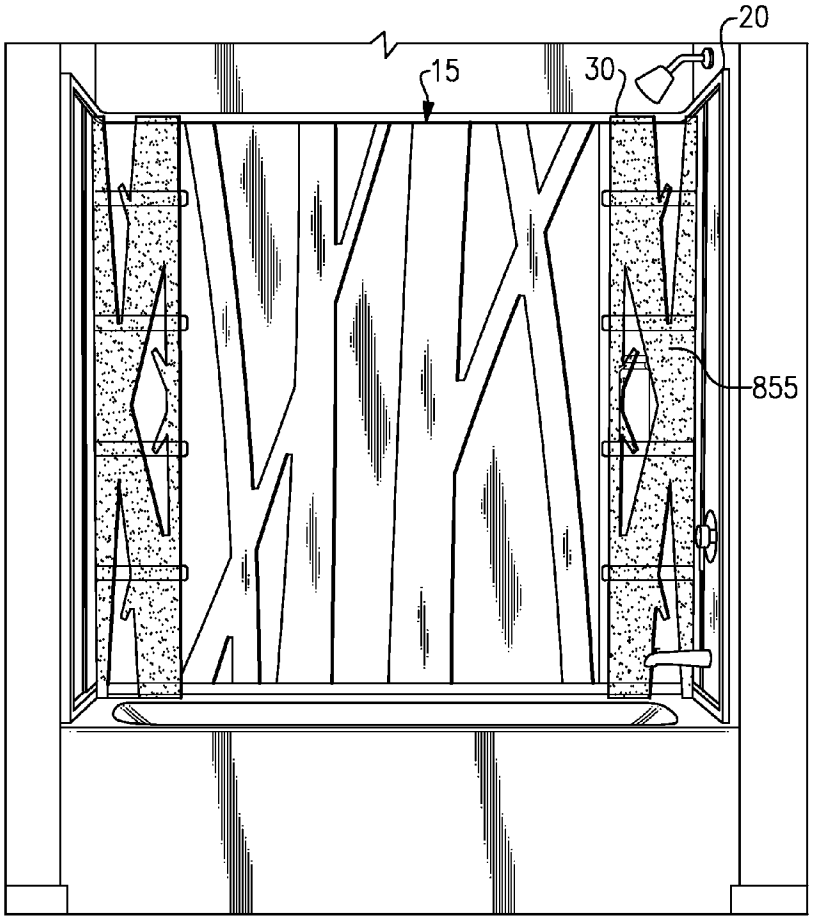
FIGS. 8A and 8B illustrate a shower surround according to another non-limiting embodiment.
Figure 8A:
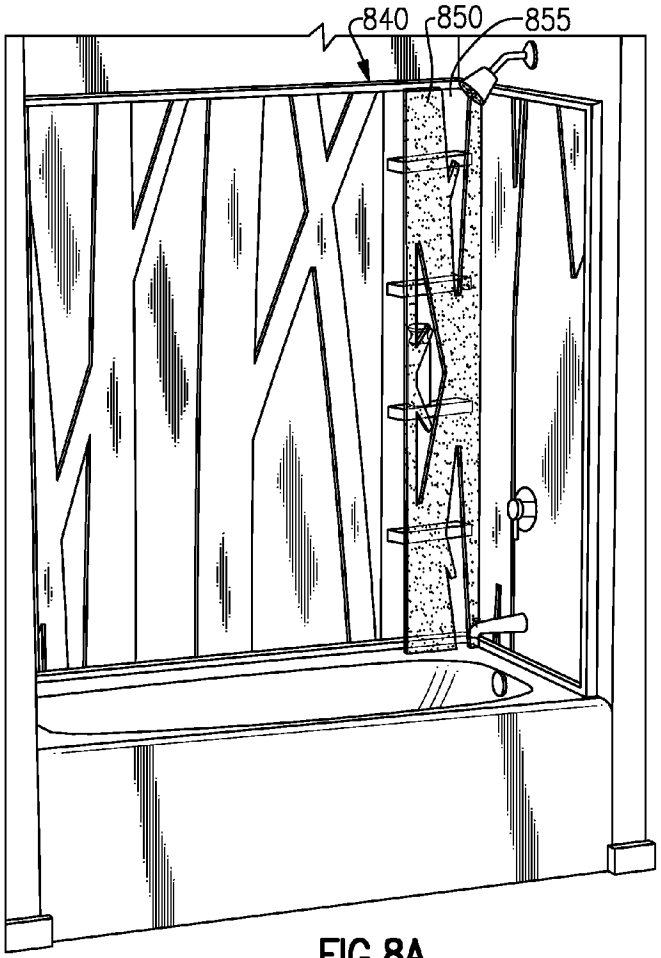

In FIGS. 8A and 8B, the front portion 850 of the corner unit 840 has a plurality of cut-outs 855 to emphasize the branch and twig design and is translucent to allow the product P to be seen therethrough.

Figure 9B:
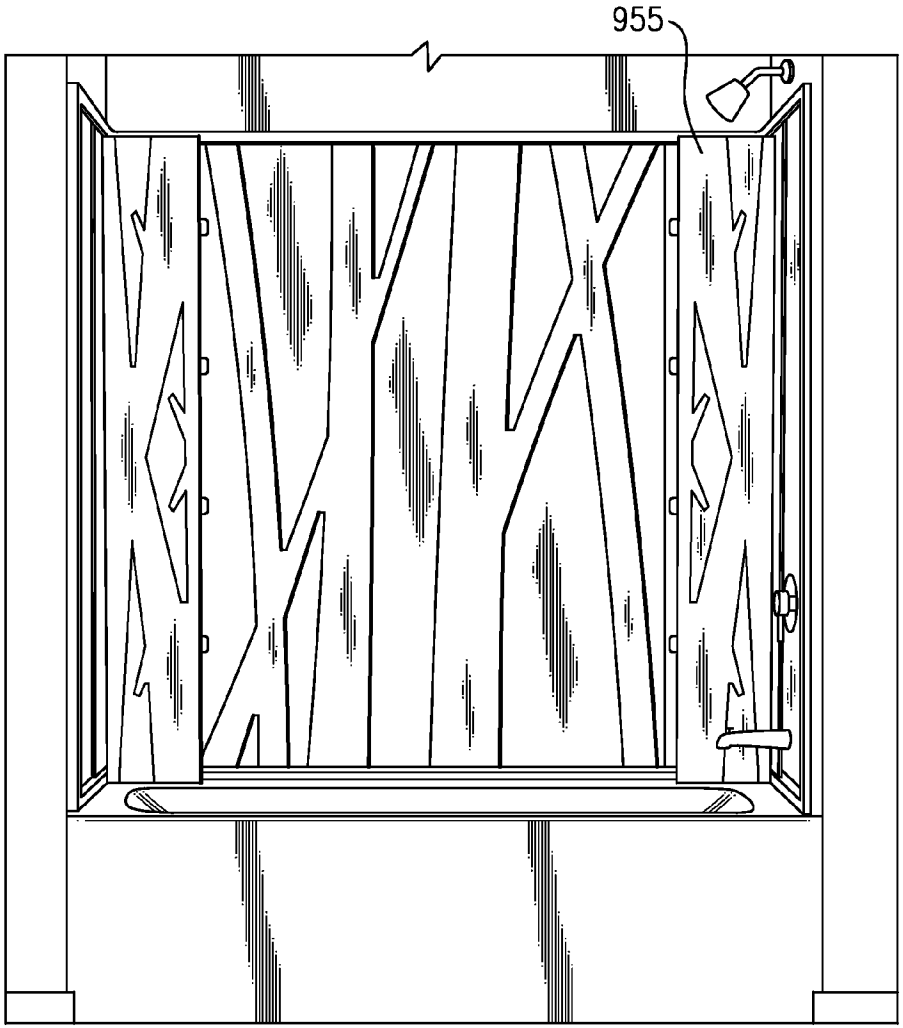
FIGS. 9A and 9B illustrate a shower surround according to another non-limiting embodiment.
Figure 9A:
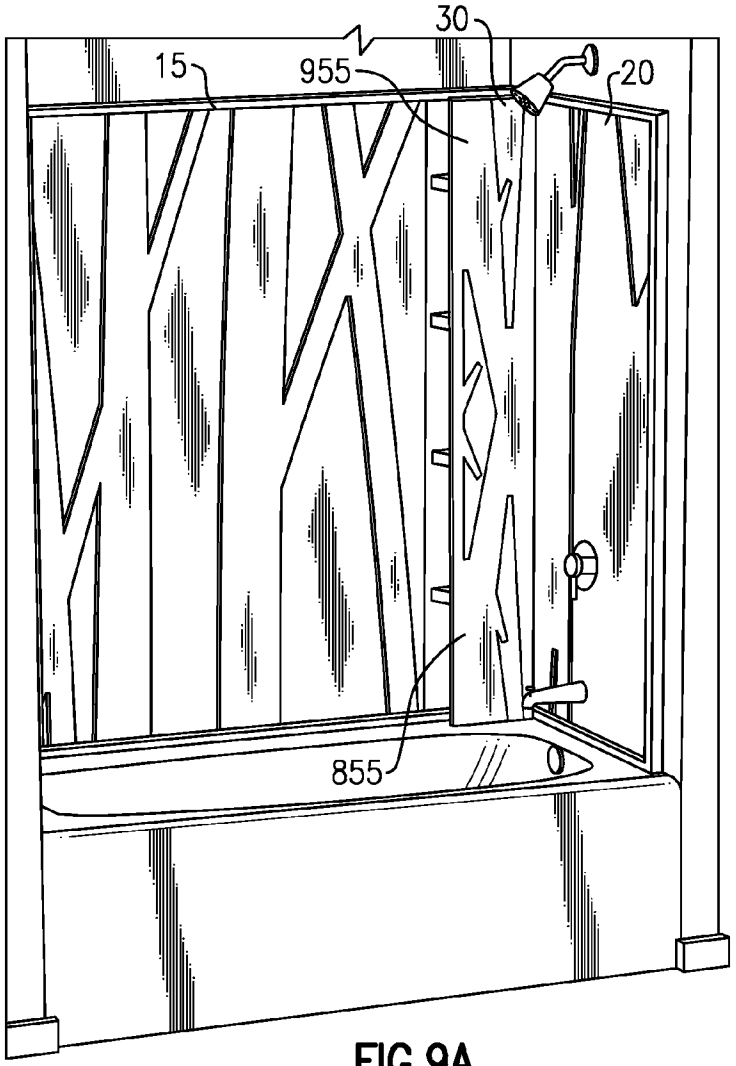

In FIGS. 9A and 9B, the front portion 955 is opaque, without cutouts, and the shelves are barely visible from the front of the surround 10.

Figure 10B:
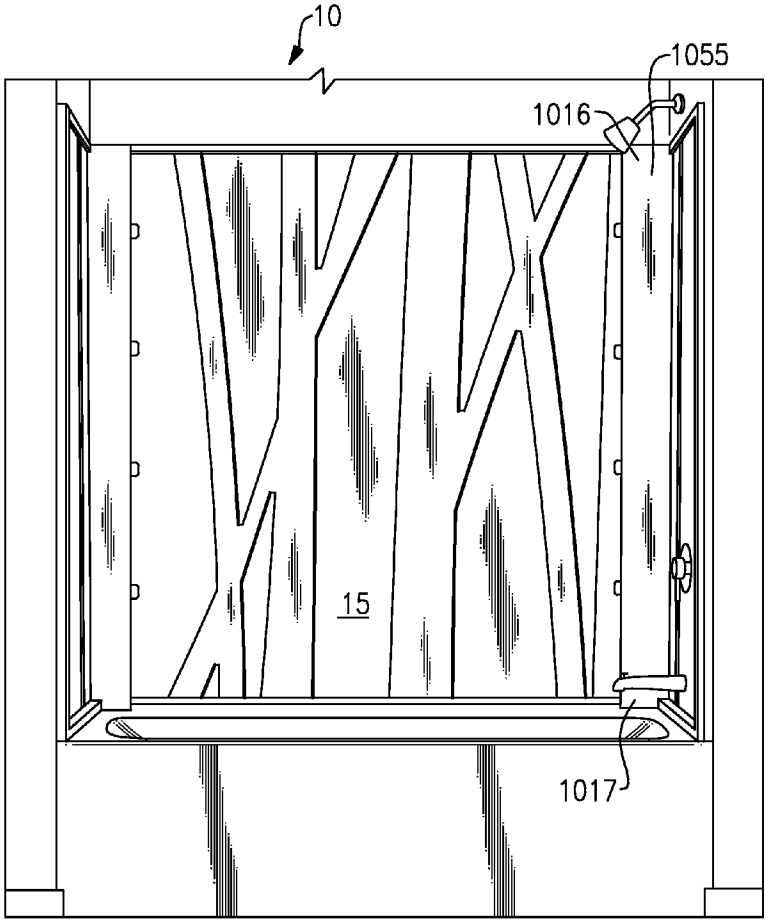
FIGS. 10A and 10B illustrate a shower surround according to another non-limiting embodiment.
Figure 10A:
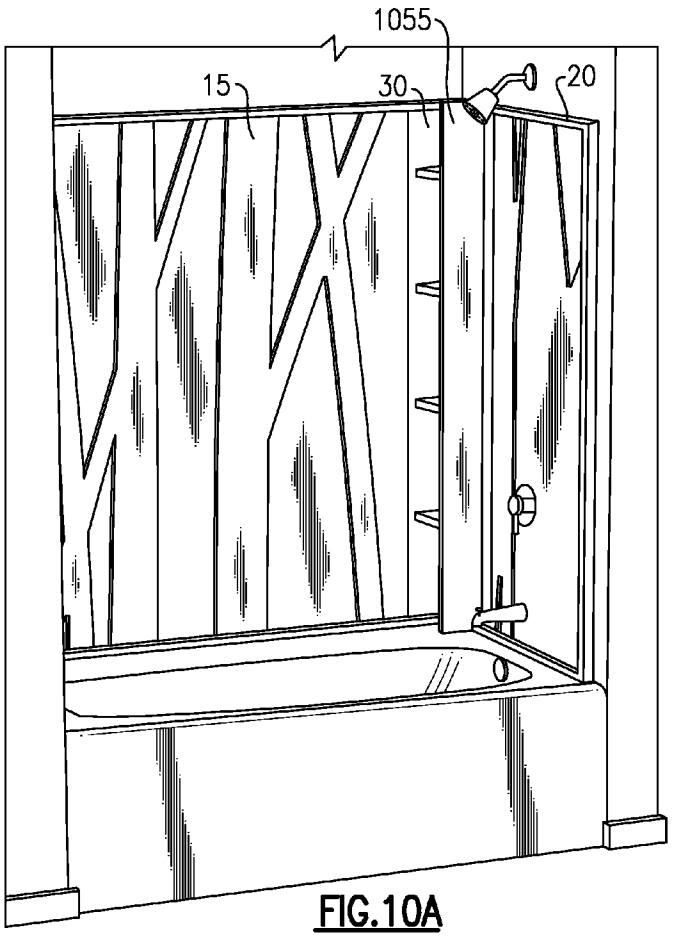

In FIGS. 10A and 10B, the front portion 1055 of the corner piece forms a plain wall that does not share the design of the back wall. The front portion tilts towards the front of the surround 10 from the top 1016 of the back wall towards the bottom 1017 of the back wall.

It should be understood that like reference numerals identify corresponding or similar elements throughout the several drawings. It should also be understood that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. For instance, one of ordinary skill in the art will recognize that other designs such as objects, abstracts, architectural features may be substituted for the designs shown herein. It is therefore to be understood that within the scope of the appended claims, the invention may be practiced other than as specifically described. For that reason the appended claims should be studied to determine true scope and content.

What is claimed is:

1. A surround comprising:

a back wall having a decorative portion;

a side wall;

a corner piece connecting said back wall and said side wall; and a shelving unit that includes at least one open shelf extending away from said corner piece, wherein a front portion of said shelving unit extends from and is integral with said corner piece positioned on a side of and is integral with said at least one shelf, such that said front portion at least partially blocks a sight line to said at least one shelf, wherein at least a portion of said shelving unit has a decorative section that mimics said decorative portion of said back wall.

2. The surround as set forth in claim 1, wherein said shelving unit includes a plurality of shelves.

3. The surround as set forth in claim 1, wherein said front portion has a curved portion having both a horizontal and a vertical component.

4. The surround of claim 1 wherein said front portion forms a seamless whole with said side wall.

5. The surround of claim 1 wherein said decorative section of said shelving unit comprises an architectural form.

6. The surround of claim 1 wherein said decorative portion of said back wall is window-shaped.

7. The surround as set forth in claim 1, wherein said decorative portion is window-shaped and includes a curved upper portion, a pair of side portions extending downwardly from said curved upper portion, and a sill connecting said pair of side portions.

8. The surround as set forth in claim 7, wherein said sill provides a shelf that is configured to receive a product for storing.

9. The surround as set forth in claim 1, wherein said shelving unit includes complementary top and bottom curved portions.

10. The surround as set forth in claim 1, wherein said decorative portion of said back wall includes a curved upper portion and said front portion of said shelving unit includes at least one of a curved upper portion and a curved lower portion that mimics said curved upper portion of said decorative portion of said back wall.

11. The surround as set forth in claim 1, wherein said front portion conceals a significant portion of said at least one shelf such that a product stored on said at least one shelf is concealed from view.

12. The surround as set forth in claim 1, wherein said decorative portion of said back wall includes a sill that provides a shelf.

13. The surround as set forth in claim 1, wherein said back wall, said side wall and said corner piece are edged by a molding.

14. The surround as set forth in claim 1, wherein a back of said front portion of said shelving unit is attached to said at least one shelf and said at least one shelf is attached to a back portion of said corner piece.

* * * * *

UNITED STATES PATENT AND TRADEMARK OFFICE

CERTIFICATE OF CORRECTION

PATENT NO. : 8,800,073 B2
APPLICATION NO. : 12/533110
DATED : August 12, 2014
INVENTOR(S) : Victor Hoernig et al.

It is certified that error appears in the above-identified patent and that said Letters Patent is hereby corrected as shown below:

Title Page, item (75),

IN THE INVENTORS:

Fourth inventor *Andrew Mercidita* should read as --Mercidita Andrew--

Signed and Sealed this
Third Day of March, 2015

Michelle K. Lee

Michelle K. Lee
*Deputy Director of the United States Patent and Trademark Office*